US011761190B2

(12) United States Patent
Yeoman et al.

(10) Patent No.: US 11,761,190 B2
(45) Date of Patent: Sep. 19, 2023

(54) STORMWATER INLET SEAL AND A STORMWATER INLET

(71) Applicant: Stormwater360 Group Limited, Auckland (NZ)

(72) Inventors: Gregory Paul Yeoman, Waiheke Island (NZ); Michael Morton Hannah, Herne Bay Auckland (NZ)

(73) Assignee: Stormwater360 Group Limited, Rosedale (NZ)

( * ) Notice: Subject to any disclaimer, the term of this patent is extended or adjusted under 35 U.S.C. 154(b) by 0 days.

(21) Appl. No.: 17/379,125

(22) Filed: Jul. 19, 2021

(65) Prior Publication Data

US 2022/0025633 A1 Jan. 27, 2022

(51) Int. Cl.
*E03F 5/04* (2006.01)

(52) U.S. Cl.
CPC ..... *E03F 5/0404* (2013.01); *E03F 5/0411* (2013.01)

(58) Field of Classification Search
CPC ..... E03F 5/04; E03F 5/0401; E03F 5/0404; E03F 5/041; E03F 5/0411; E02D 29/14; E02D 29/1463
USPC ..... 210/163, 164, 170.03, 747.2, 747.3; 404/2, 4, 5, 25
See application file for complete search history.

(56) References Cited

U.S. PATENT DOCUMENTS 286,951 A * 10/1883 McBee ..... B01D 29/05 210/163
1,541,436 A * 6/1925 Reshan ..... E02D 29/14 210/163
2,003,770 A * 6/1935 Goodhart ..... E03F 5/042 210/163
5,615,526 A * 4/1997 Palmer ..... E04D 13/0409 210/163
6,214,216 B1 4/2001 Isaacson
6,668,390 B1 * 12/2003 Gonzalez ..... E03F 5/0404 210/163
7,208,082 B2 * 4/2007 Hurst ..... E03F 5/0404 210/164
8,017,004 B2 * 9/2011 Crumpler ..... E03F 5/0404 210/170.03
8,608,956 B2 12/2013 Moulton et al.
8,715,491 B2 * 5/2014 Shaw ..... E03F 5/041 210/163
9,194,116 B2 11/2015 Bailey
9,322,156 B2 * 4/2016 McInnis ..... E03F 5/0404
9,624,658 B2 4/2017 Hannah et al.
10,294,655 B2 * 5/2019 Murphy, III ..... E03F 5/0404
(Continued)

FOREIGN PATENT DOCUMENTS

JP 2008-267006 A 11/2008

*Primary Examiner* — Joseph W Drodge
(74) *Attorney, Agent, or Firm* — Merchant & Gould P.C.

(57) ABSTRACT

Stormwater inlets and stormwater inlet seals are disclosed. The stormwater inlet seal can include a first section and a second section. The first section and/or second section at least partially defines an opening in the stormwater inlet seal. The first section can be pivotally connected to the second section about an edge of the first section. The first section can be moveable between a first position in which the first section is biased towards a closed position to direct fluid towards the opening and a second position which allows access to the inlet. A stormwater inlet with a first section that is pivotally connected to a sidewall is also disclosed.

7 Claims, 11 Drawing Sheets

(56) References Cited

U.S. PATENT DOCUMENTS

| | | | | |
|---|---|---|---|---|
| 10,508,430 | B2 | 12/2019 | Riley et al. | |
| 10,597,862 | B1 | 3/2020 | Downare | |
| 10,907,338 | B1 * | 2/2021 | Happel | E03F 5/0403 |
| 2005/0207839 | A1 * | 9/2005 | Tremouilhac | E03F 5/046<br>404/4 |
| 2009/0014371 | A1 * | 1/2009 | Cook | E03F 5/0404<br>210/164 |
| 2017/0284077 | A1 * | 10/2017 | Deurloo | B01D 29/96 |

* cited by examiner

STORMWATER INLET SEAL AND A STORMWATER INLET

FIELD

This invention relates to a stormwater inlet seal and a stormwater inlet including such a stormwater inlet seal.

SUMMARY

In some configurations, a stormwater inlet can comprise: an inlet having an entrance and a plurality of sidewalls; and a stormwater inlet seal configured to guide fluid entering the inlet through an opening in the stormwater inlet seal into the inlet, comprising:

a first section and a second section, wherein the first section and/or second section at least partially defines the opening in the stormwater inlet seal;

wherein the first section is pivotally connected to the second section about an edge of the first section; and wherein the first section is moveable between a first position in which the first section is biased towards a closed position to direct fluid towards the opening and a second position which allows access to the inlet.

In some configurations, the first section can be biased by a spring.

In some configurations, the stormwater inlet seal can include a hinge.

In some configurations, the first section can comprise a substantially rigid plate.

In some configurations, the first section can further comprise a sealing layer.

In some configurations, the sealing layer can be at least partially formed from a hydrocarbon-resistant material.

In some configurations, the sealing layer can be at least partially formed from a UV-resistant material.

In some configurations, the first section can include one or more projecting brushes.

In some configurations, the second section can be at least partially supported by a frame.

In some configurations, one or more sides of the second section can be inclined so as to guide fluid through the opening of the stormwater inlet seal.

In some configurations, the first section can be provided with a catch to facilitate lifting of the first section.

In some configurations, the catch can be an eye hook.

In some configurations, an access portal can be at least partially defined by the first section with an area of greater than 500 $cm^2$.

In some configurations, an access portal can be at least partially defined by the first section extending across a width of the inlet.

In some configurations, an access portal can be at least partially defined by the first section extending across a length of the inlet.

In some configurations, the first section can at least partially seal against a sidewall of the stormwater inlet when the first section is in the first position.

In some configurations, a stormwater inlet seal can comprise:

a first section and a second section, wherein:

the first section and/or second section at least partially defines an opening in the stormwater inlet seal; and the first section is pivotally connected to the second section about an edge of the first section; and the first section is moveable between a first position in which the first section is biased towards a closed position to direct fluid towards the opening and a second position which allows access to an inlet; and the stormwater inlet seal is configured to guide fluid entering the inlet through the opening into the inlet.

In some configurations, a stormwater inlet seal can be configured to guide fluid entering a stormwater inlet through an opening in the seal and can include an inspection port having a port cover slideable between a position in which the inspection port is covered and a position in which the inspection port is uncovered.

In some configurations, the stormwater inlet seal can further comprise at least one guide rail configured to guide the slideable port cover between the covered and uncovered positions.

In some configurations, a stormwater inlet can comprise: an inlet having an entrance and a plurality of sidewalls; and a stormwater inlet seal configured to guide fluid entering the inlet through an opening in the stormwater inlet seal into the inlet, comprising:

a first section and a second section, wherein the first section and/or second section at least partially defines the opening in the stormwater inlet seal;

wherein the first section is pivotally connected to at least one of the sidewalls; and wherein the first section is moveable between a first position in which the first section is biased towards a closed position to direct fluid towards the opening and a second position which allows access to the inlet.

BRIEF DESCRIPTION OF THE DRAWINGS

The accompanying drawings which are incorporated in and constitute part of the specification, illustrate examples of the invention and, together with the general description of the invention given above, and the detailed description of examples given below, serve to explain the principles of the invention, in which.

DETAILED DESCRIPTION

Stormwater inlets are used in a range of applications to collect and direct water (such as rain or surface runoff) into a chamber or volume below ground level to help ensure adequate drainage and prevent surface flooding. This kind of infrastructure is used in a variety of non-limiting contexts and circumstances, and the term 'stormwater inlet' inclusively refers to catchbasins, pits, gulleys, gulley pits, catch pits, or manholes.

A grate usually covers the entry to the stormwater inlet to mitigate accidental injury to people or animals and to prevent larger detritus from entering the chamber or volume below the inlet. Smaller pieces of debris may nevertheless pass through the grate, and a debris trap (such as a bag or filter) can be installed within the stormwater inlet to catch and prevent smaller debris from entering the inlet while also allowing the collected fluid to pass through.

Although stormwater inlets are designed to convey water away, standing or stagnant water can accumulate either by design or due to blockage etc. This can attract mosquitos and other disease vectors and may necessitate periodic monitoring or inspection of stormwater inlets for vector control. Stormwater inlets may also need to be inspected for maintenance or servicing. Visual inspection of the stormwater inlet and the chamber below the inlet may be required, although the debris trap beneath the grating can obstruct an inspector's line of sight from the surface. Objects or items (such as a sample container, camera, mosquito pellets, or hydrocarbon absorbing bags) may also need to be introduced into the stormwater inlet from the surface, but the presence of the debris trap within the stormwater inlet can interfere with this process.

It may be possible to temporarily remove the debris trap to allow for visual inspection or for the introduction of items into the stormwater inlet, but this can require labour, equipment and time. The grating may also need to be removed in order to access the debris trap, further compounding the time and effort spent inspecting the stormwater inlet.

Figure 1:
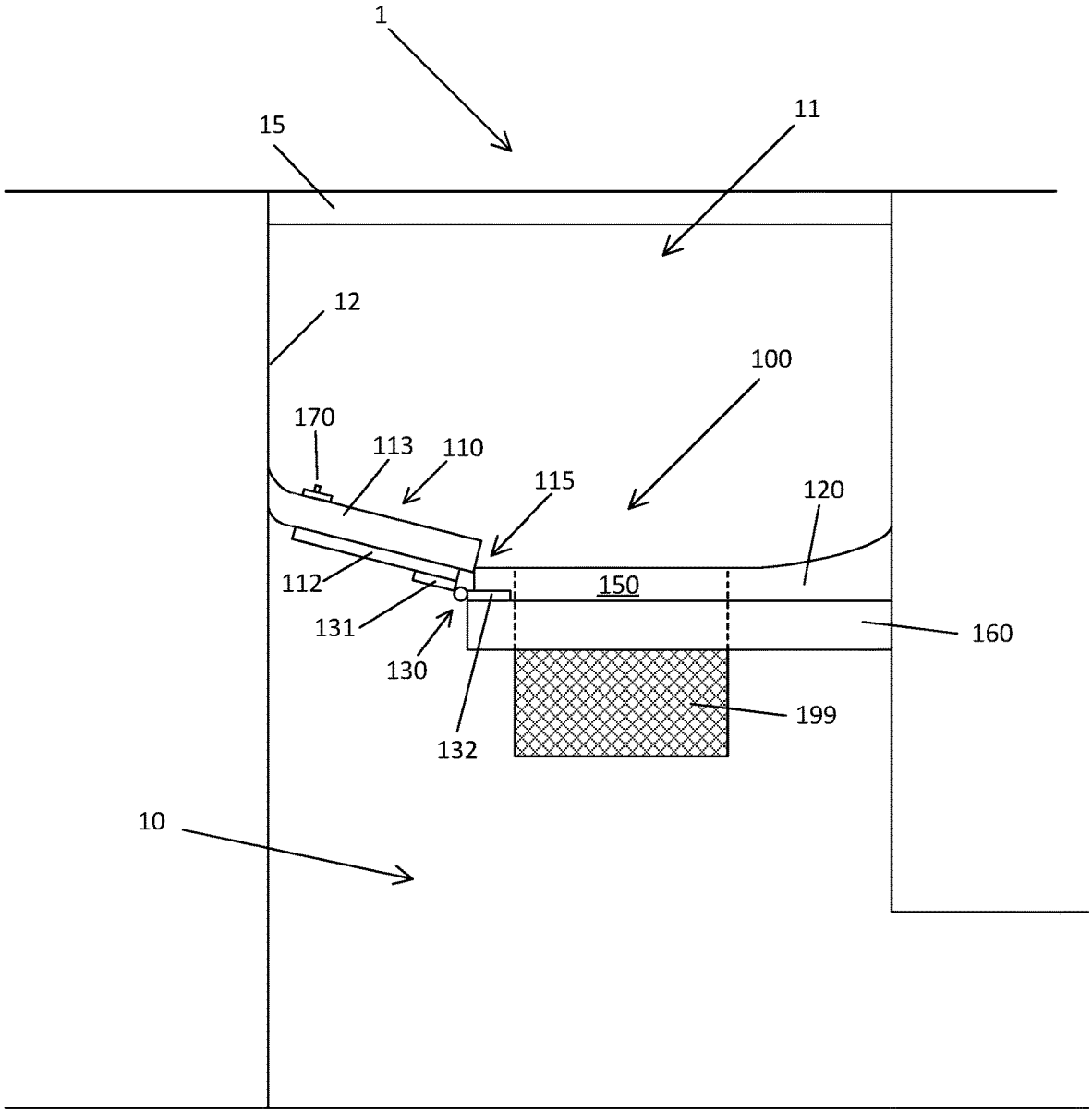
FIG. 1 is a cross-sectional side view of a stormwater inlet including a seal in its closed configuration.

FIG. 1 illustrates a stormwater inlet 1 according to an example. The stormwater inlet 1 includes an inlet 10 which has an entrance 11 and a plurality of sidewalls 12. The entrance 11 is usually covered by a grate 15. The stormwater inlet 1 further includes a stormwater inlet seal 100. The stormwater inlet seal 100 includes a first section 110 and a second section 120. The first section 110 and/or the second section 120 at least partially define an opening 150 in the stormwater inlet seal 100. The stormwater inlet seal 100 is configured to guide and direct fluids (e.g. rain, surface runoff, etc.) through the opening 150 in the stormwater inlet seal 100 and into the inlet 10. A debris trap 199 can be positioned within the opening 150 to intercept debris entering the stormwater inlet 1. In some examples, the debris trap 199 can be a bag or container formed by a net or porous material.

Figure 2:
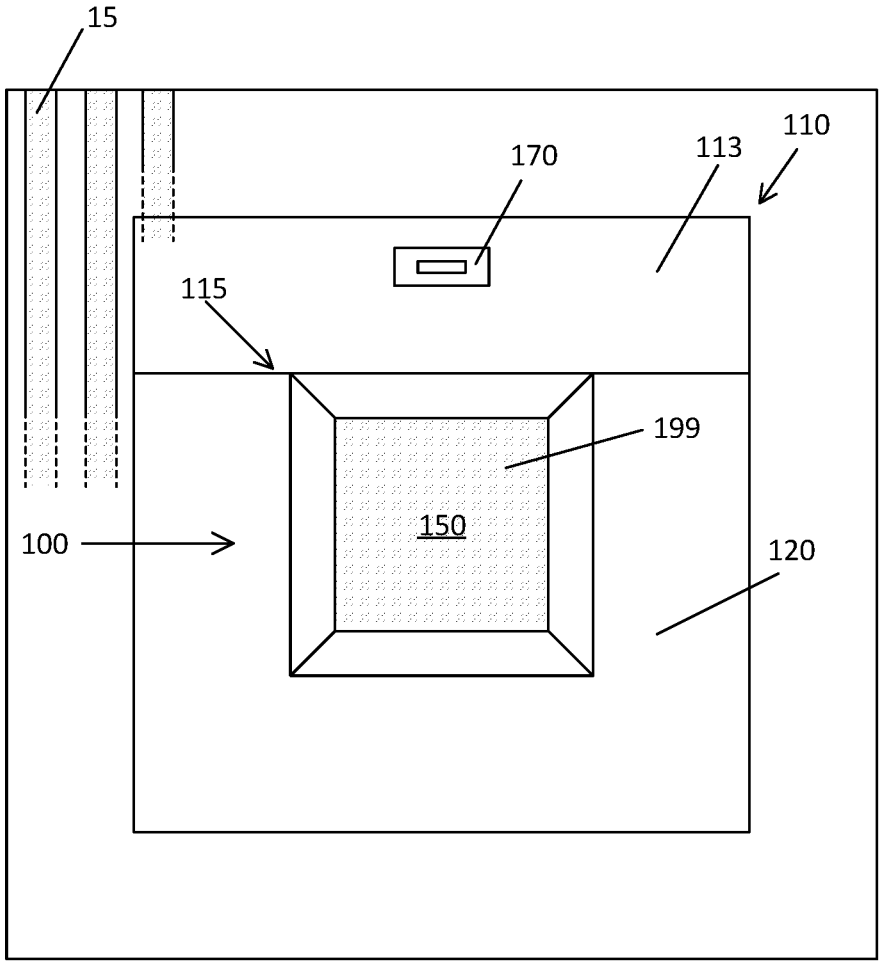
FIG. 2 is a plan view of the stormwater inlet shown in FIG. 1.

FIG. 2 shows a plan view the stormwater inlet 1, looking through the entrance 11. The grate 15 is only partially depicted for the sake of clarity. The first section 110 of the stormwater inlet seal 100 is pivotally connected to the second section 120 about at least one edge 115 of the first section 110. The pivotal connection between the first and second sections 110 and 120 allows the first section 110 to hinge and move with respect to the second section 120. The first section 110 usually assumes (and is biased towards) a closed position against a side wall 12 to direct fluid towards the opening 150 but is moveable about edge 115 to a second position away from wall 12 which allows access to the inlet 10. When the stormwater inlet 1 is to be inspected, an inspector can lift and rotate the first section 110 about its edge 115 to move the first section 110 from the first position to the second position, thereby allowing access to the stormwater inlet 1 without removing the stormwater inlet seal 100 or the debris trap 199. The lifting and moving of the first section 110 from the first position to the second position can be facilitated by a catch 170, which is described in more detail below. The inspector may not need to move the grating 15 to inspect the stormwater inlet 1 when the first section 110 is in the second position, although a portion of the grating 15 can be movable between an open and closed position to facilitate access to the inlet 10, as described further below.

At this point, it should be noted that the stormwater inlet seal 100 does not need to create a watertight or absolute seal with inlet 10. The term 'seal' is used within the context of the art of stormwater drainage infrastructure, and a substantial seal between the stormwater inlet seal 100 and the inlet 10 can be acceptable depending on the application of the stormwater inlet seal 100. Generally speaking, the seal should be effective to exclude debris over a certain size and in some applications to also contain vectors.

Figure 3:
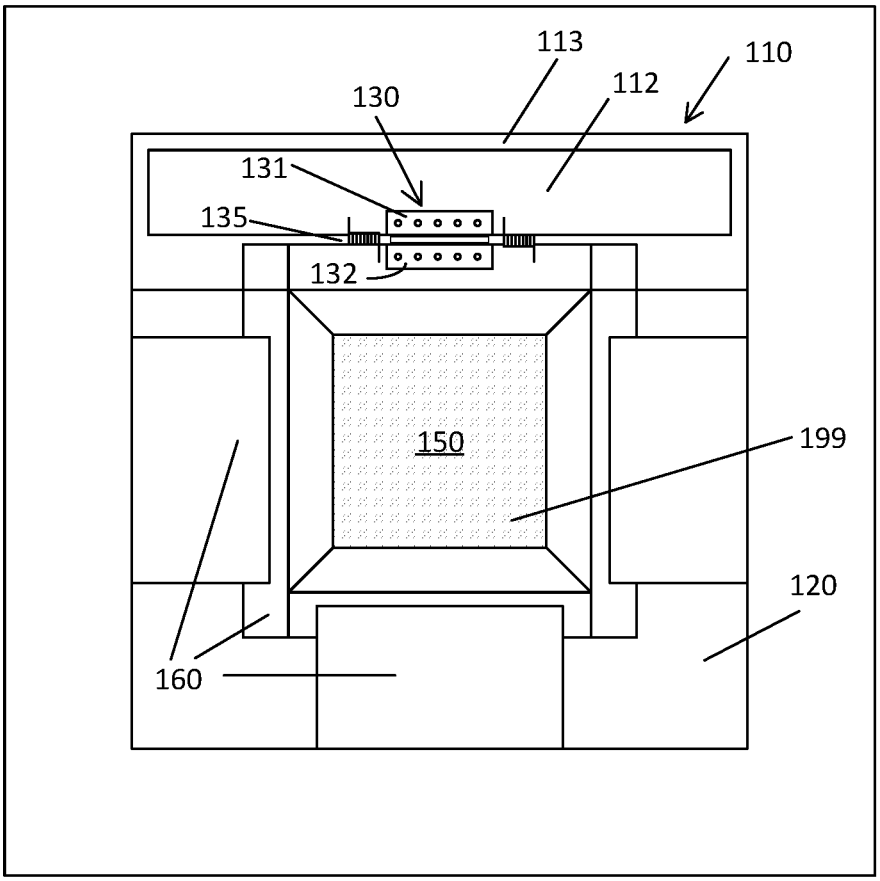
FIG. 3 is a plan view of the stormwater inlet shown in FIG. 1 viewed from below.

FIG. 3 shows the stormwater inlet of FIGS. 1 and 2 from beneath. Hinge 130 allows the first section 110 to pivot in relation to the second section 120. A first leaf 131 of the hinge 130 may be attached to the first section 110, while the second leaf 132 of the hinge 130 may be attached to the second section 120.

Figure 4:
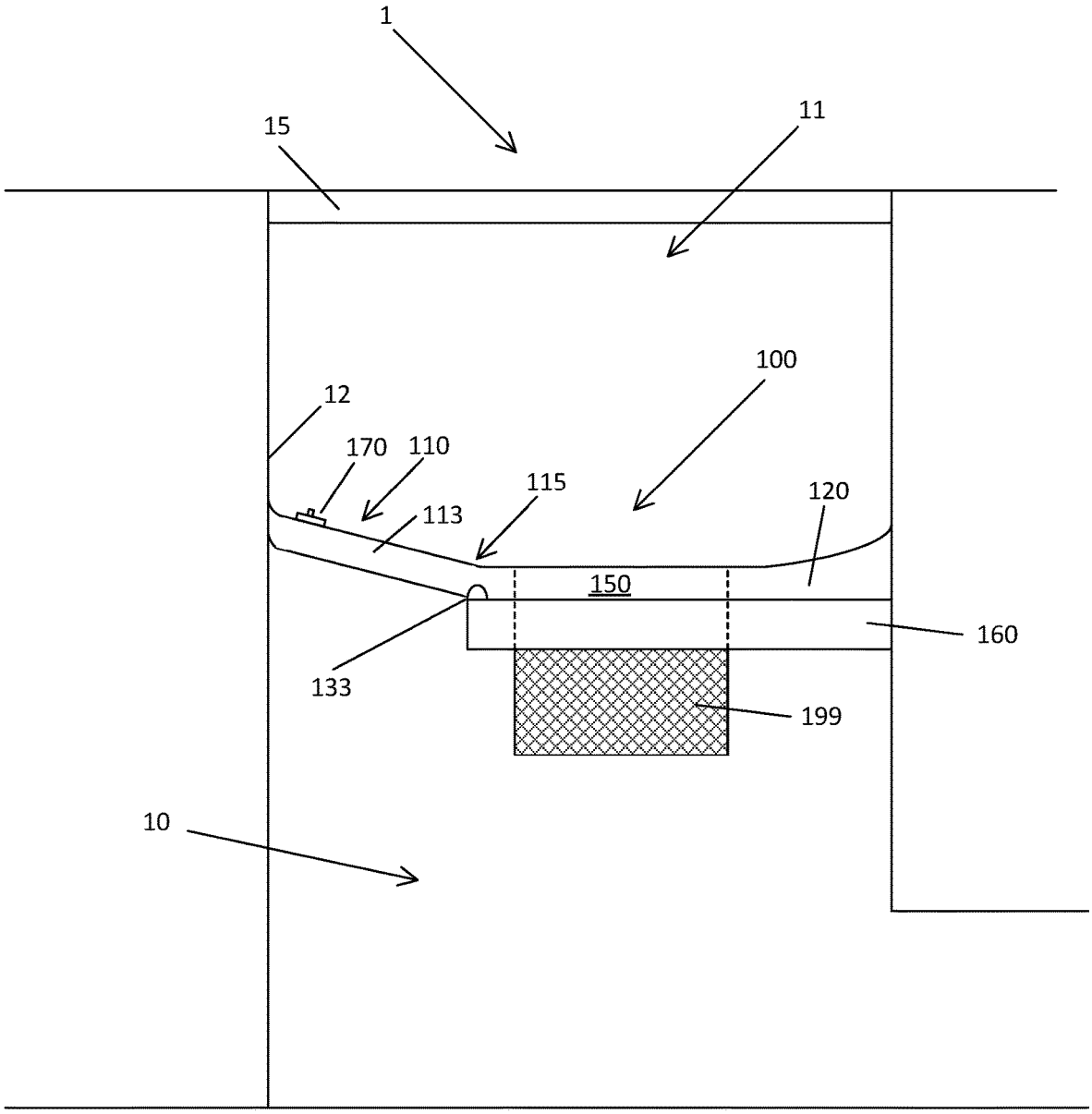
FIG. 4 is a cross-sectional side view of a stormwater inlet including a seal having a living hinge.

In other examples, the hinge 130 may be a 'living hinge'. As a non-limiting example, the first section 110 and second section 120 can be one contiguous body separated by a living hinge 133 formed by one or more notches or cuts. FIG. 4 depicts a side view of an example of a stormwater inlet 1 and stormwater inlet seal 100 with a living hinge formed by a groove 133 in the material of the first section 110 and second section 120, the uppermost surface of which defines the edge 115 about which the first section 110 pivots. The living hinge is defined by a body formed of a material with sufficient resilience and bias to allow the first section 110 to hinge upwards and allow access to the inlet 10. For example, the body defining the living hinge may be formed of suitable plastics material.

In some examples, the first section 110 and second section 120 can be separate, and the living hinge can be defined at some point along the body of the first section 110. In further examples, the first section 110 and second section 120 can be bridged by a separate component which defines a living hinge and is formed of a suitable material. In any case, the living hinge may not be notched or cut per se, and can be defined without the removal of any material (e.g. during manufacturing or fabrication.) Whether a hinge 130 or a living hinge is used and its corresponding form and configuration can depend on the application of the stormwater inlet 1 and stormwater inlet seal 100.

The hinge 130 shown in FIG. 3 can also include a spring 135 which biases the first section 110 towards the closed position in which first section 110 is biased towards side wall 12. The first section 110 is normally held in this first position when the stormwater inlet seal 100 is installed within the stormwater inlet 1 by the biasing force of spring 135. In use, the force of flow entering the inlet further forces the first section against side wall 12 to maintain the seal and avoid bypassing of debris trap 199. The biasing action of the spring 130 must be overcome to allow movement of the first section 110 from the closed position. This reduces the possibility of the first section moving so as to unintentionally allow access to the inlet and can improve the sealing action between the first section 110 and the sidewall(s) 12 via the force abutting the two or more. This abutment can restrict the freedom of pivotal movement of the first section 110 towards the closed position and can prevent the first section 110 from being accidentally forced underneath the second section 120.

In other examples, the spring 135 can be separate from the hinge 130 itself; as a non-limiting example, the spring 135 can be a torsion spring with two legs, each of which are respectively embedded into (or otherwise integrated/attached with) the first section 110 and second section 120. In still further examples, the spring 135 can be replaced with an entirely different component which functions to bias the first section 110 towards the closed position, such as a counterweight arranged to pull the first section 110 towards the abutting sidewall through the force of gravity. In still further examples, a spring-loaded protrusion or abutting projection can be attached or installed to the sidewall 12 and configured to impinge upon and bias the first section 110. The particular configuration of the spring 135, or other component used to bias the first section 110, can depend on the application of the stormwater inlet seal 100.

The structural portion of the first section 110 can include a substantially rigid plate 112, constructed from a resilient metal such as stainless steel. If a hinge 130 is used with the stormwater inlet seal 100, the first leaf 131 can be attached to the substantially rigid plate 112. The substantially rigid plate 112 can have a sealing layer 113 on its upper surface extending beyond its edges. The sealing layer 113 can be formed of a comparatively soft or malleable material which deforms to some extent and adapts to conform with the profile of the sidewall 12 with which it abuts due to the biasing force of the spring 135. This can provide effective sealing between the sealing layer 113 and side walls 12, although it is once again noted that 'seal' is a relative term used within this particular context and does not imply or connote a complete or watertight seal. It is acceptable and expected that at least some amount of water will pass between the stormwater inlet seal 100 and inlet 10, although the majority will be directed towards the opening 150 and debris trap 199 if present. It is also desirable that the sealing layer 113 be formed at least partially by a hydrocarbon resistant material and/or a UV resistant material to increase the longevity of the sealing layer 113. Nitrile rubber is one example of a suitable material and is also sufficiently malleable to conform with the profile of the abutting sidewall 12.

Figure 5:
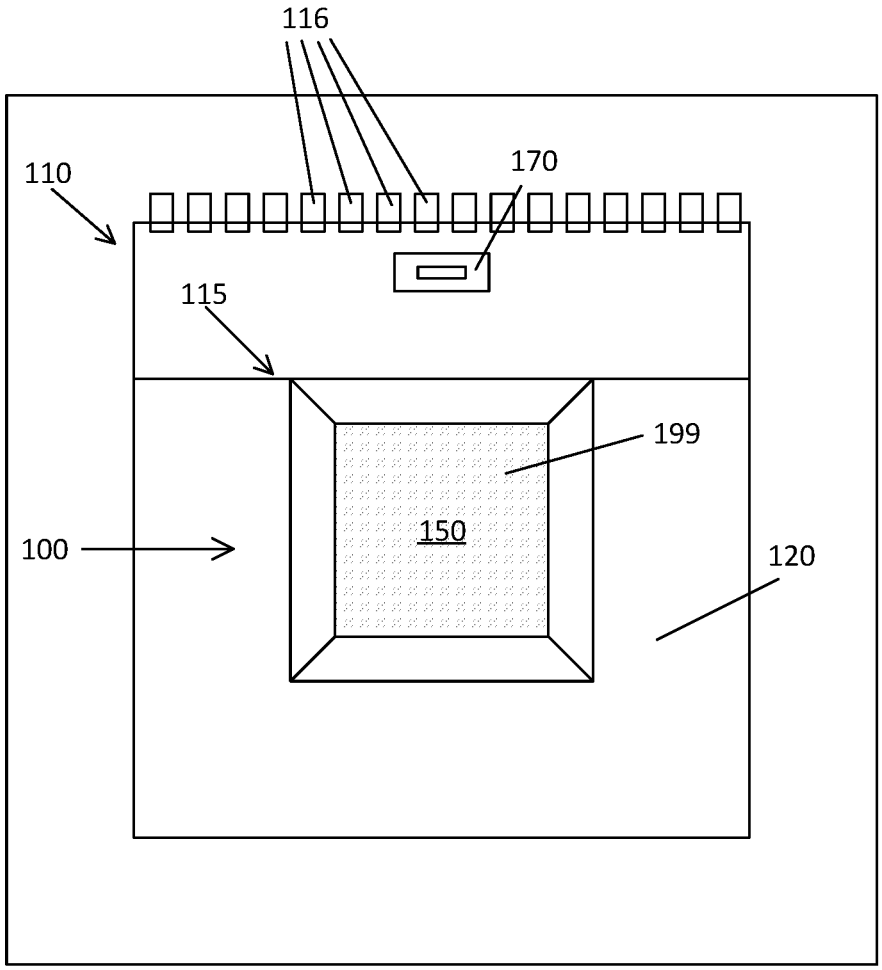
FIG. 5 is a plan view of a stormwater inlet including a seal having brush seals.

In some examples, the sealing layer 113 can be a ring or line of brushes or brush-like arrangements projecting from one or more edges of the substantially rigid plate 112. One non-limiting example is depicted in a top-down view in FIG. 5. The projecting brushes can abut and seal against the sidewall(s) 12 of the inlet 10 from the biasing force of the spring 135. Each brush can comprise an assembly or array of individual fingers or projections 116 (size exaggerated) which can overlap one another or can be separated by a gap. Depending on the sealing requirements and applications of the stormwater inlet 1 and stormwater inlet seal 100, the gaps can be approximately 5 millimetres or less. For vector control the gaps can be approximately 1 millimetre or less. Overlapping fingers 116 can be used if necessary.

The abutting arrangement between the first section 110 (and/or sealing layer 113) with the sidewall 12, along with the 'handedness' of the hinge 130 (i.e. the direction in which the first section 110 must rotate to allow access from the closed position), means that the efficacy of the stormwater inlet seal 100 can be increased during high flow volume through the stormwater inlet 1. When the first section 110 is in the closed position (which is the default position due to the bias of the spring 135), fluid which flows through the entrance 11 of the stormwater inlet 1 and falls onto the first section 110 presses the section harder against the abutting sidewall 12. This increases the sealing action between the two and further reduces the chance of the first section 110 unintentionally moving and allowing the fluid to bypass the opening 150. Even if a substantial amount of fluid is not flowing through the entrance 11, the function of the first section 110 and stormwater inlet seal 100 overall is ameliorated by this advantageous configuration.

In some examples, the stormwater inlet seal 100 can include a frame 160 which can at least partially support the first section 110 and/or the second section 120. The frame 160 is typically positioned beneath the first section 110 and second section 120 (although configurations with the frame 160 above the two sections are possible) and is formed of a sufficiently strong material such as metal or high-strength plastic to support the weight of the assembly. The frame 160 can be structurally secured to one or more sidewalls 12 of the inlet 10. Multiple attachments to two or three sidewalls 12 are possible, or equivalently two/three separate points if the inlet 10 is circular or has another non-rectangular shape in cross-section. FIG. 3 depicts an example which includes a frame 160 attached at three points. The frame 160 can also be secured to all four sidewalls 12 including the sidewall 12 against which the first section 110 (and/or sealing layer 113) abuts, although the attachment must be arranged so that it will not impede inspection or access to the inlet 10 when the first section 110 has been moved from the closed position.

The frame can surround the opening 150 which is at least partially defined by the first section 110 and/or second section 120. In some examples, the second leaf 132 of the hinge 130 can be attached to the frame 160, while the first leaf 131 can be attached to the first section 110. In particular, the first leaf 131 can be attached to the substantially rigid plate 132 if included in the first section 110. The second section 120 can be of a unitary plastic construction and can also be attached to the frame 160. In other examples, the second section 120 can be composed of two or more separate bodies which can overlap and can be collectively or individually attached to the frame 160. Bolts or rivets can be used between the two sections and the frame 160, although other connections or attachments which enable the frame 160 to at least partially support either or both sections are also possible. The debris trap 199 (or its frame if applicable) can also be secured to or otherwise supported to some degree by the frame 160.

In other examples, a frame 160 may not be included with the stormwater inlet seal 100, and the first section 110 and/or second section 120 can be attached or secured directly to the sidewalls 12 of the inlet 10. Whether a frame 160 is used will depend on the application of the stormwater inlet seal 100.

The stormwater inlet seal 100 is configured to guide flow (e.g. water) entering the inlet 10 through the opening 150 of the stormwater inlet seal 100. One or more sides of the first section 110 and/or second section 120 can be inclined with respect to the opening 150 so as to guide fluid towards the opening 150 of the stormwater inlet seal 100. FIG. 1 depicts a side view of a non-limiting example of stormwater inlet seal 100 with an inclined first section 110 and second section 120 to this effect. The majority of the water which passes through the entrance 11 of the inlet 10 will run down the first section 110 and the second section 120 towards the opening 150 under the force of gravity.

The first section 110 will generally be inclined with respect to the opening 150 due to the pivotal connection between the both sections and the spring 135 abutting the first section 110 and/or sealing layer 113 with the sidewall 12. One or more sides of the second section 120 can be inclined with respect to the opening 150 to further this effect. The sides of the first section 110 and second section 120 (or stormwater inlet seal 100 in general) can have the geometry of an inverted truncated square pyramid (e.g. a square frustum) with the opening 150 positioned at the bottom-most face. In other examples, one or more sides may not be inclined with respect to the opening 150.

Figure 6:
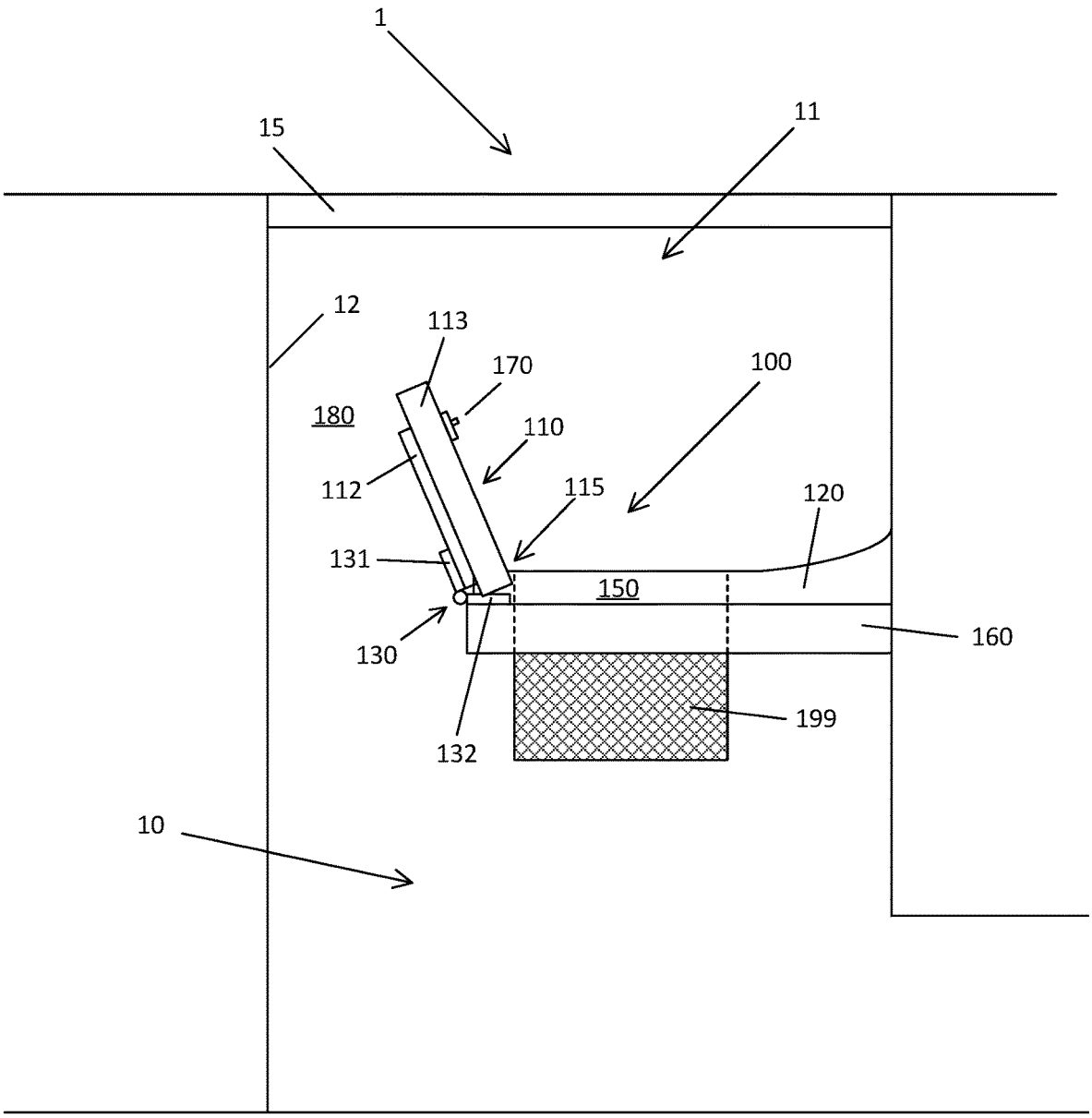
FIG. 6 is a cross-sectional side view of a stormwater inlet as shown in FIG. 1 with the seal in an open configuration to provide an access portal.
Figure 7:
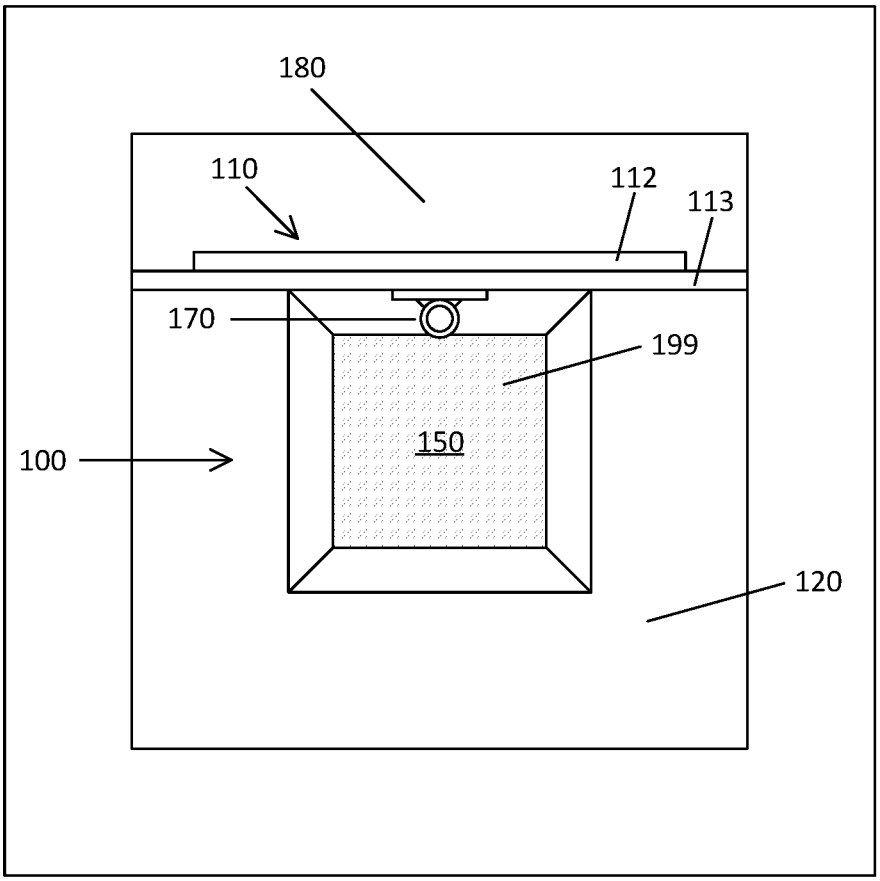
FIG. 7 is a plan view of the view shown in FIG. 6.

If an inspector wishes to move the first section 110 from the closed position in order to allow access to the inlet 10, the first section 110 must be lifted and rotated about its hinge 130 and against the biasing force of the spring 135 into an open position as illustrated in FIGS. 6 and 7. The first section 110 can include a catch 170 which facilitates the lifting of the first section 110. For example, the catch 170 may be an eye hook protruding from the top face of the first section 110. The inspector can use a tool such as a J-hook (or other implement configured to engage with the catch 170) to lift the first section 110 to the position shown in FIGS. 6 and 7 to access or inspect the inlet 10. The catch 170 can ideally be reached through the grate 15 using the appropriate tool without removing the grate 15. This can simplify and expedite the inspection process as no component of the stormwater inlet 1 needs to be uninstalled by the inspector. However, if desired, the grate may be removed before first section 110 is lifted.

The catch 170 can be configured in a wide variety of different ways depending on the application of the stormwater inlet 1 and stormwater inlet seal 100. For example, the catch 170 may be a plate or projection which is shaped to receive a J-hook. In other examples, the catch 170 can be a hook or a J-hook itself, and the corresponding tool used by the inspector can terminate in an eye hole or suitable loop to engage the catch 170. In still further examples, a rod can be provided within the stormwater inlet 1 and can be permanently coupled to the catch 170. The inspector can then lift the rod to access the inlet 10 without needing to provide a tool of their own. However, if the rod protrudes out of the grate 15, it may be impacted by traffic at the ground level.

In still further examples, the catch 170 can be replaced with a rope which can extend from the first section 110 and can be permanently or semi-permanently installed. The rope can be made accessible to the inspector to facilitate the lifting of the first section 110 and can be stowed above or below the grate 15. Whether a rope is used with or instead of a catch 170 or provided rod will depend on the application of the stormwater inlet 1 and/or stormwater inlet seal 100.

When the inspector has engaged the catch 170 and lifted the first section 110 to expose the inlet 10, the gap left between the abutting sidewall 12 and the first section 110 at least partially defines an access portal 180. The stormwater inlet 1 as depicted in FIGS. 6 and 7 shows the first section 110 in the open position in providing an access portal 180. The access portal 180 can establish a line of site to the bottom of the inlet 10 from the ground level and allows the inspector to introduce (or remove) items or objects through the access portal 180. Advantageously, the overall configuration between the first section 110 and the stormwater inlet seal 100 allows various sizes or areas of access portals 180. In some examples, the access portal 180 may be 500 $cm^2$ or greater when the first section 110 has been lifted and allows access to the inlet 10. In some examples, the access portal 180 can run across an entire width or an entire length of a cross-section of the inlet 10. Configurations with large access portals 180 can allow the inspector to introduce larger objects (such as hydrocarbon absorbing bags or large cameras) into the inlet 10 or collect samples from the inlet 10 without removing or uninstalling any component of the stormwater inlet seal 100.

It also can be advantageous to use a grate 15 which has a section movable between an open position and a closed position. This can allow the inspector to introduce or remove larger objects or items to/from the inlet 10 and through the grate 15 without needing to completely remove the grate 15. For example, the grate 15 can have a sliding section or hinged section which can be moved to open an area of the grate 15. The area of the section can correspond to the area of the access portal 180 when the first section 110 allows access to the inlet 10. In other examples, a standard grate 15 can be used. The inspector can be able to introduce a camera or other items/objects to/from the inlet 10 between the individual bars of the grate 15. If a larger item is used, the grate 15 can be removed by the inspector.

Although the examples of the stormwater inlet 1 depicted illustrate stormwater inlet seals 100 with smaller first sections 110 and larger second sections 120, the invention is not limited in this respect. In other examples a stormwater inlet seal can have a larger first section that the section. In such an example, the first section can meet the opening along three mutual edges. Because the first section pivots upwards with respect to the second section, the first section does not come into contact or interfere with the debris trap. In these examples, the other components of the stormwater inlet seal (e.g. the hinge and spring) can be substantially the same as those described above.

Figure 10:
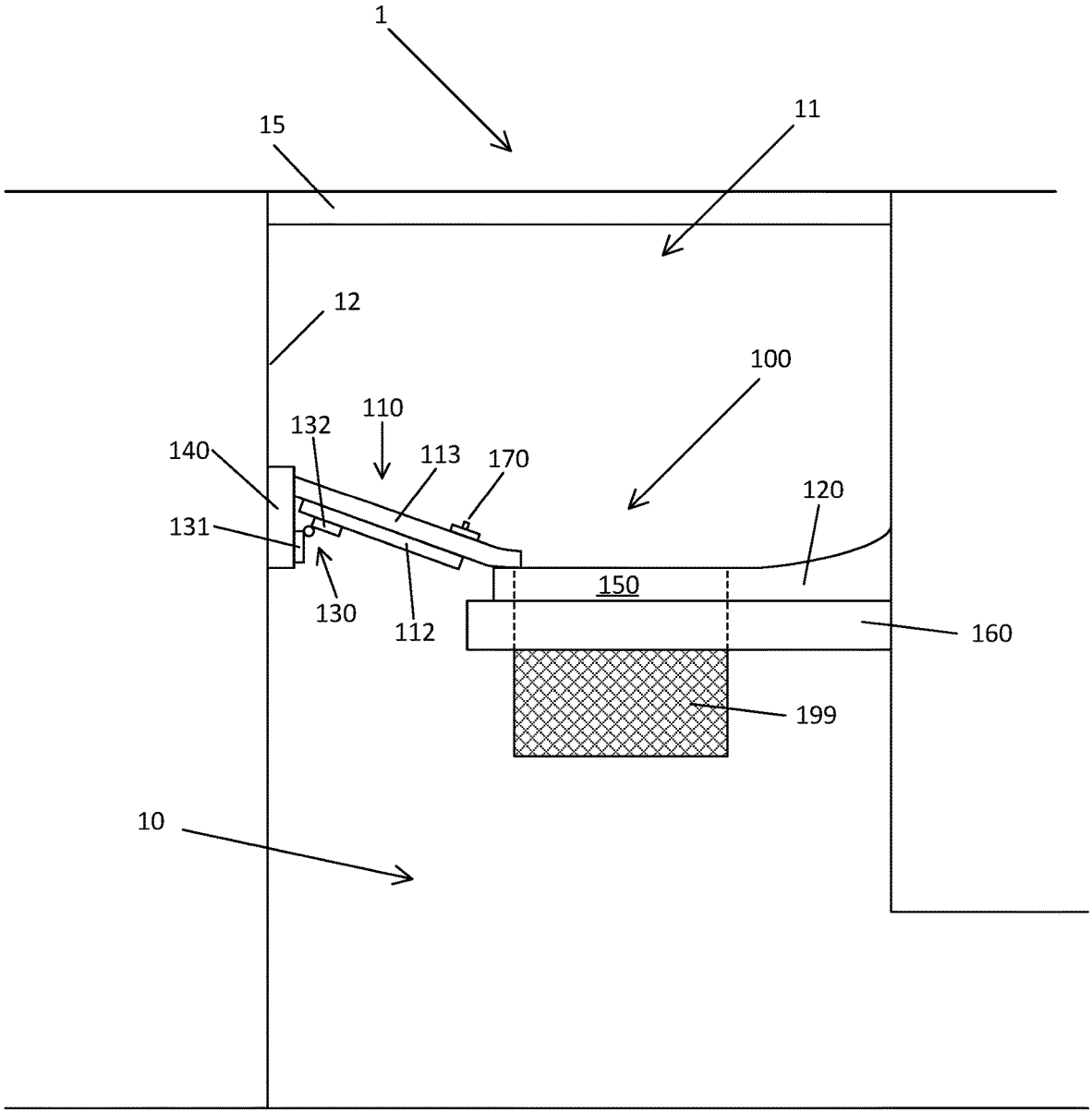
FIG. 10 is a cross-sectional side view of a stormwater inlet including a seal with a pivotal connection to a sidewall.

Furthermore, although the examples depicted so far illustrate the first section 110 abutting against the sidewall 12, this is not limiting. In some configurations, the first section 110 can be pivotally connected to a sidewall 12 rather than the second section 120 and can abut against the second section 120 in the closed position. FIG. 10 depicts a non-limiting example of a stormwater seal 100 with a first section 110 pivotally connected to at least one sidewall 12. In this non-limiting example, the first leaf 131 of the hinge 130 is attached to a flange 140, which in turn is secured to the sidewall 12. The second leaf 132 of the hinge 130 is secured to the substantially rigid plate 112 of the first section 110. A spring or other biaser (not depicted) urges the first section 110 down towards the second section 120 such that the sealing layer 113 abuts the second section 120 when the first section 110 is in the closed position. The spring or other biasing component has already been described in relation to examples where the first section 110 abuts against the sidewall 12. The first section 110 also includes a catch 170 to facilitate the lifting of the first section 110 to access the inlet 10, as has been described above. In other examples where the first section 110 abuts against the second section 120, the stormwater seal 100 may not include a flange 140, and the first section 110 may have a direct pivotal attachment to the sidewall 12. Furthermore, the stormwater seal 100 can include additional flanges 140 which can be attached to additional sidewalls of the inlet 10.

Figure 11:
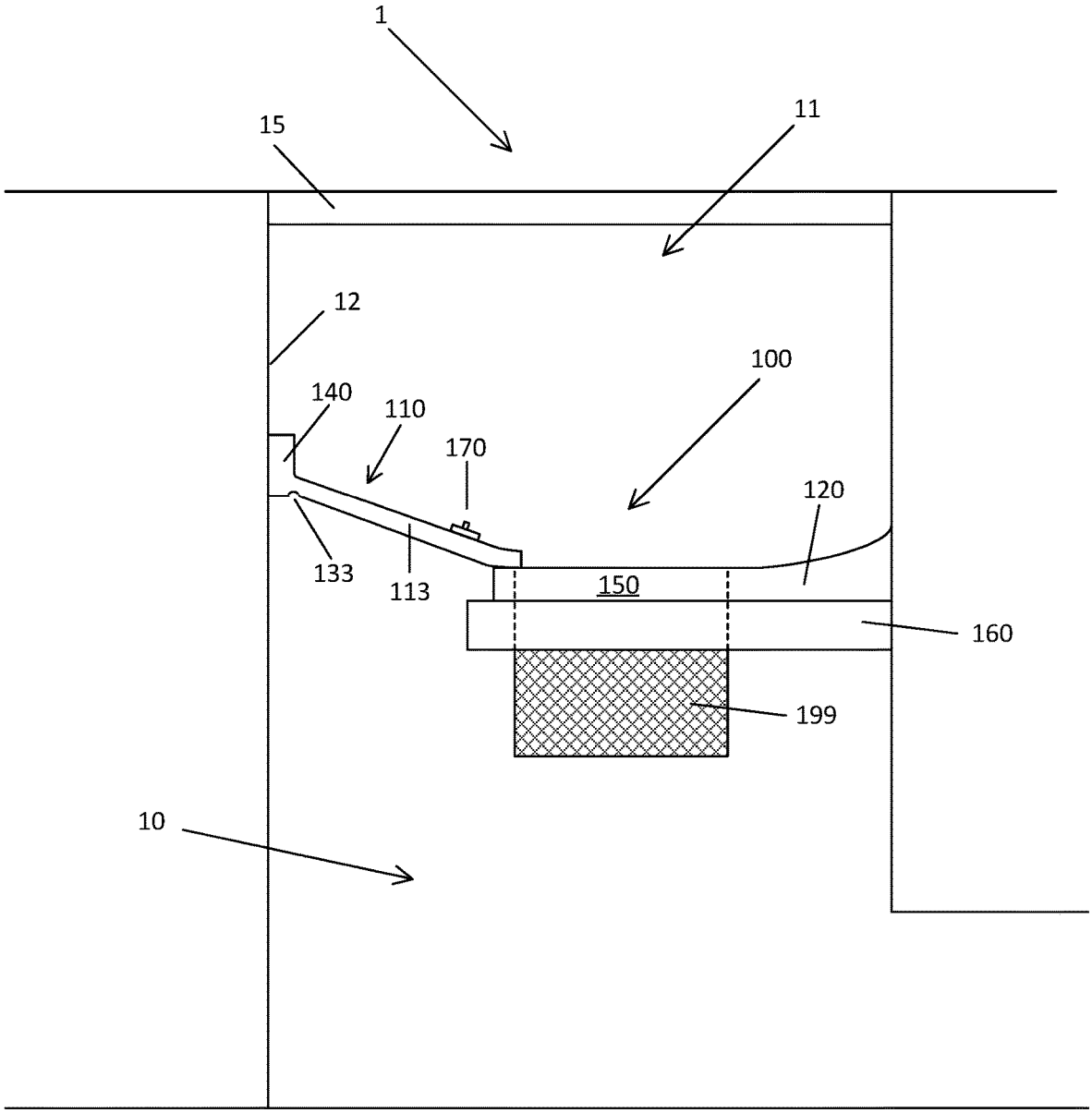
FIG. 11 is a cross-sectional side view of a stormwater inlet including a seal having a living hinge and with a pivotal connection to a sidewall.

Examples of stormwater seals 100 having first sections 110 which are pivotally connected to the sidewall 12 can vary in substantially the same ways as stormwater seals 100 having first sections 110 which are pivotally connected to the second sections 120, while accounting for the differences in their respective pivotal connections. For example, FIG. 11 depicts a non-limiting example of a stormwater seal 100 which includes a first section 110 pivotally attached to a sidewall 12 and also includes a living hinge 133. This non-limiting example is essentially the equivalent of the non-limiting example of the stormwater seal 100 depicted in FIG. 4, except the first section 110 is pivotally connected to the sidewall 12 rather than the second section 120. In the non-limiting example illustrated in FIG. 11, the first section 110 includes a sealing layer 113 which is integrally formed with the flange 140, and a living hinge 133 is defined by a groove in the underside of the first section 110. In other examples, the sealing layer 113 and flange 140 may be separate, and the living hinge 133 can be a separate piece of material bridging the flange 140 and sealing layer 113 to define the pivotal connection between the sidewall 12 and the first section 110.

In still further examples, the stormwater inlet 1 can include a pair of stormwater inlet seals with two mutually opposing first sections. The stormwater inlet seals may essentially comprise two mutually-opposing stormwater inlet seals having first and second sections, which are substantially described above. The exact configurations of the different components can vary depending on the application of the stormwater inlet seal.

Figure 8:
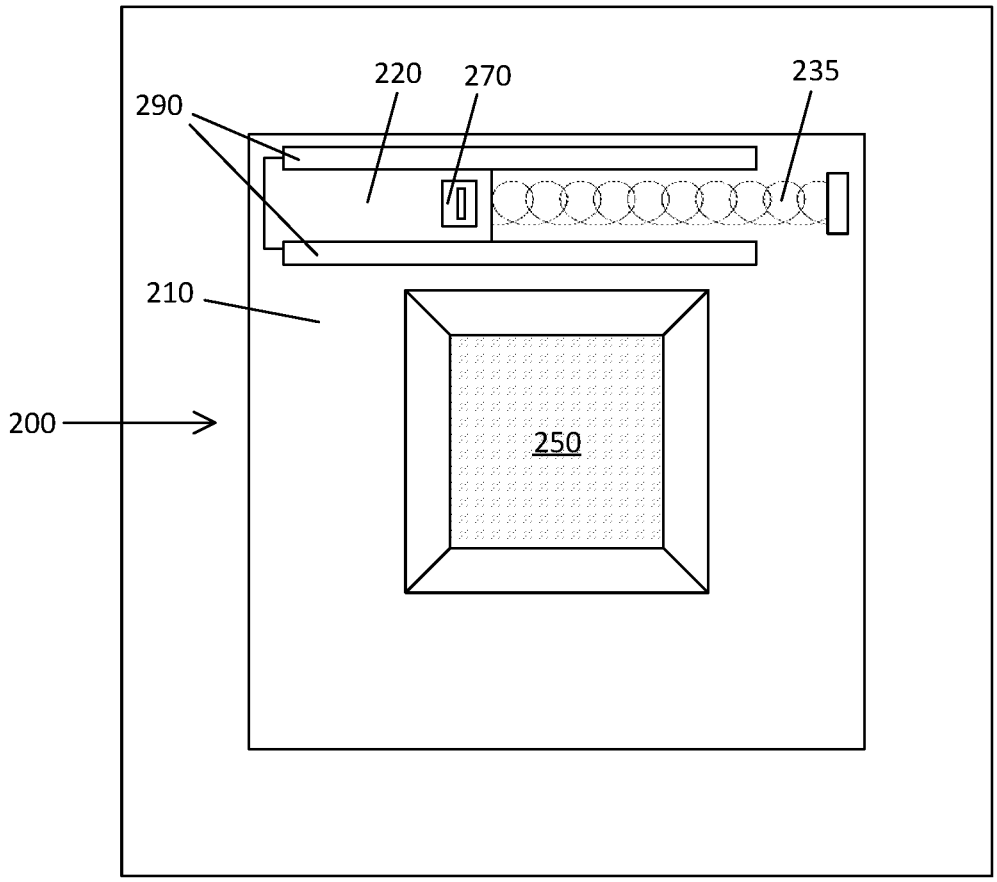
FIG. 8 is a plan view of a stormwater inlet including a seal with a sliding cover in a closed position.
Figure 9:
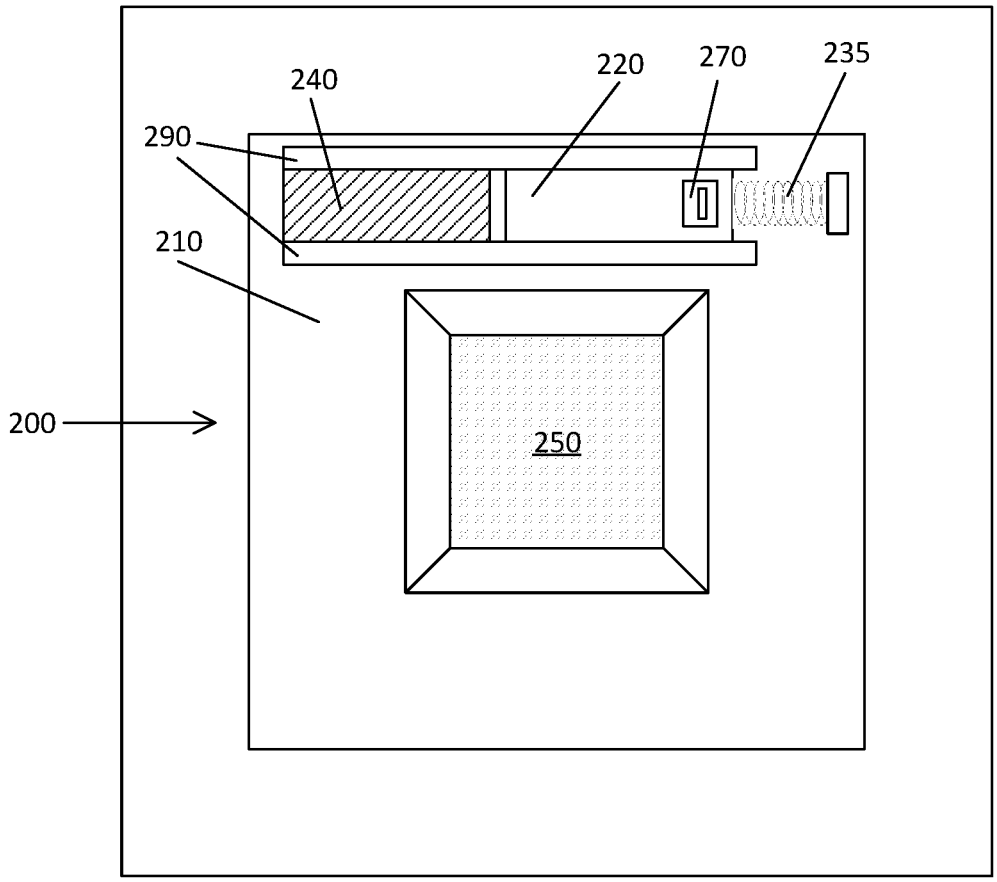
FIG. 9 is a plan view of the stormwater inlet seal depicted in FIG. 8 with the siding cover in the open position.

In still further examples, the stormwater inlet seal can include an inspection port which can be covered or uncovered by a sliding cover. One example is depicted in FIGS. 8 and 9. In this non-limiting example, the stormwater inlet seal 200 includes a body 210 and sliding cover 220. The body 210 can at least partially define an opening 250 and an inspection hatch 240. The sliding cover 220 can cover the inspection hatch 240 when the sliding cover 220 is in the closed position (as shown in FIG. 8) and can uncover the inspection hatch 240 when the sliding cover is in the open position (as shown in FIG. 9.) The sliding cover 220 can be supported by one or more guide rails 290 which guide the sliding motion of the sliding cover 220. A spring 235 or other biasing component can urge the sliding cover 220 towards the covered position. The sliding cover can include a catch 270 which may be any suitable projection that facilitates the sliding of the sliding cover by an inspector from the ground level using a tool such as a rod etc. The catch 270 can be slid by the inspector in order to uncover the inspection hatch 240 and may have a shape and configuration as described in relation to the catch 170 of the stormwater inlet seal 100.

In some further examples, the stormwater seal 200 can include a sliding cover 220 which is configured to slide towards (and potentially abut against) the sidewall 12 when the sliding cover 220 is in the closed position. For example, with respect to the specific and non-limiting example illustrated in FIGS. 8 and 9, the sliding cover 220 can be configured to slide up and down rather than left and right (as depicted). The sliding cover 220 can extend across the entire length of width of the body 210 and can slide laterally or longitudinally with respect to the body 210. The sliding cover 220 can also be positioned beneath the body 210 (rather than overlapping the top face of the body 210). In still further examples, the sliding cover 220 of the stormwater seal 200 can be functionally equivalent to the first section 110 of a stormwater seal 100 having a pivotal connection to a second section 120 or sidewall 12, while the body 210 can be functionally equivalent to the second section 120. In these examples, the spring or other biasing component 235 can laterally bias or urge the sliding cover to abut the sidewall and to close the inspection hatch 240.

While the present invention has been illustrated by the description of the examples thereof, and while the examples have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. An insert for a stormwater inlet, the insert comprising:
a frame; and
a substantially rigid plate pivotally connected to the frame by at least one hinge; wherein:
the frame is configured to at least partially support a debris trap;
the frame is configured to be secured to at least one sidewall of the stormwater inlet; and
the insert is configured so that, when in use:
the insert defines an access portal between the insert and a sidewall of the stormwater inlet; and
the substantially rigid plate is movable between:
a closed portion; and
an open position which allows access to the stormwater inlet through the access portal.

2. The insert of claim 1, wherein the substantially rigid plate abuts a sidewall of the stormwater inlet in the closed position.

3. The insert of claim 1, wherein the substantially rigid plate comprises a catch to facilitate lifting of the substantially rigid plate.

4. The insert of claim 1, wherein the access portal has an area of at least 500 $cm^2$.

5. The insert of claim 1, wherein the access portal extends across a width of the inlet.

6. The insert of claim 1, wherein the access portal extends across a length of the inlet.

7. The insert of claim 1, wherein the substantially rigid plate can be lifted and rotated to move the substantially rigid plate from the closed position to the open position.

* * * * *